US009896285B2

(12) United States Patent
Anzai et al.

(10) Patent No.: US 9,896,285 B2
(45) Date of Patent: Feb. 20, 2018

(54) MEDIUM CONVEYANCE DEVICE

(71) Applicant: Oki Data Corporation, Tokyo (JP)

(72) Inventors: Kae Anzai, Tokyo (JP); Hiromi Kusunoki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/132,354

(22) Filed: Apr. 19, 2016

(65) Prior Publication Data

US 2016/0347562 A1 Dec. 1, 2016

(30) Foreign Application Priority Data

May 29, 2015 (JP) ..... 2015-109558

(51) Int. Cl.

| | |
|---|---|
| ***B65H 3/04*** | (2006.01) |
| ***B65H 3/52*** | (2006.01) |
| ***B65H 7/04*** | (2006.01) |
| ***B65H 7/18*** | (2006.01) |
| ***B65H 3/06*** | (2006.01) |

(52) U.S. Cl.

CPC ..... *B65H 3/042* (2013.01); *B65H 3/063* (2013.01); *B65H 3/523* (2013.01); *B65H 3/5276* (2013.01); *B65H 7/04* (2013.01); *B65H 7/18* (2013.01); *B65H 2511/518* (2013.01); *B65H 2513/512* (2013.01); *B65H 2701/1313* (2013.01)

(58) Field of Classification Search

CPC ..... B65H 3/523; B65H 3/063; B65H 2301/42322; B65H 7/04; B65H 7/18; B65H 3/042; B65H 3/5276

See application file for complete search history.

(56) References Cited

U.S. PATENT DOCUMENTS 4,961,566 A * 10/1990 Labombarde ..... B65H 3/042 271/124
5,531,432 A * 7/1996 Sardella ..... B65H 3/063 271/10.01
6,550,764 B2 * 4/2003 Wilson ..... B65H 5/34 271/270

(Continued)

FOREIGN PATENT DOCUMENTS

DE 10127993 A1 * 12/2002 ..... B65H 3/042
JP 2001-097563 A 4/2001

*Primary Examiner* — Patrick Cicchino
(74) *Attorney, Agent, or Firm* — Metrolexis Law Group, PLLC

(57) ABSTRACT

A medium conveyance device includes: a first conveyance unit that applies a first conveyance force in a conveyance direction to a lowest medium among media on a medium stacker; a second conveyance unit disposed downstream in the conveyance direction of the first conveyance unit and that applies a second conveyance force in the conveyance direction to the medium being conveyed in the conveyance direction; a detector that detects that a rear end of the lowest medium receiving the first conveyance force passes through the first conveyance unit; and a controller that controls the first and second conveyance units. Upon determining that the rear end of the lowest medium receiving the first conveyance force passes through the first conveyance unit, the controller switches the first conveyance unit from a conveyance state of applying the first conveyance force to a non-conveyance state of not applying the first conveyance force.

20 Claims, 13 Drawing Sheets

(56) References Cited

U.S. PATENT DOCUMENTS

| | | | | |
|---|---|---|---|---|
| 6,572,103 | B1 * | 6/2003 | Tranquilla | B65H 3/063 271/10.02 |
| 6,971,645 | B2 * | 12/2005 | Coret | B65H 3/042 271/137 |
| 7,331,576 | B2 * | 2/2008 | Pelletier | B65H 1/06 271/10.06 |
| 7,419,154 | B2 * | 9/2008 | Pelletier | B65H 3/126 271/121 |
| 7,621,524 | B2 * | 11/2009 | Levin | B65H 3/063 271/112 |
| 7,988,144 | B2 * | 8/2011 | Coret | B65H 3/063 271/121 |
| 8,256,760 | B2 * | 9/2012 | DaCunha | B07C 1/04 271/10.07 |
| 8,517,660 | B2 * | 8/2013 | DaCunha | B07C 1/04 271/10.01 |
| 8,596,634 | B2 * | 12/2013 | Yap | B65H 3/5246 271/10.03 |
| 8,596,635 | B2 * | 12/2013 | Yap | B65H 3/5246 271/10.03 |
| 9,242,815 | B2 * | 1/2016 | Okumura | B65H 3/063 |

* cited by examiner

MEDIUM CONVEYANCE DEVICE

CROSS REFERENCE TO RELATED APPLICATIONS

This application claims priority based on 35 USC 119 from prior Japanese Patent Application No. 2015-109558 filed on May 29, 2015, entitled "MEDIUM CONVEYANCE DEVICE", the entire contents of which are incorporated herein by reference.

BACKGROUND OF THE INVENTION

1. Field of the Invention

This disclosure relates to a medium conveyance device that convey a medium one by one out of media stacked on a medium stacker.

2. Description of Related Art

When a conventional medium conveyance device performs a medium conveyance (sheet feeding) operation to send a medium (a sheet) one by one from a medium stacker (a sheet container) in which media stacked, the medium conveyance device sends out (conveys) the lowest medium (at the bottom position) among the media so that a user can add media on the top of the stacked media even during the operation. In the medium conveyance operation, a conveyance belt comes into contact with a bottom surface of the medium located at the bottom, and applies a conveyance force in a conveyance direction to the medium. Receiving the conveyance force, the medium moves in the conveyance direction and passes through a passage (a clearance) defined between the conveyance belt and a separator opposed thereto. Thus, the single medium is separated from the rest of the media. Then, the medium thus separated is discharged to the outside of the medium conveyance device (see Japanese Patent Application Publication No. 2001-97563, for example).

SUMMARY OF THE INVENTION

However, the conventional medium conveyance device requires cumbersome adjustments, such as changing a height of the separator (a thickness of the passage) and lifting up tail ends of the stacked media, depending on states of the media including the medium type (a type of the media categorized by the thickness and material thereof), the medium length (a length of each medium), the amount of the stacked media (the remaining amount of the media), and so forth. If the adjustments are not carried out, the medium conveyance device is more likely to discharge multiple sheets of media at a time (multi-feeding).

An object of an embodiment of the invention is to provide a medium conveyance device which can reliably convey the lowest medium one by one among stacked media without requiring cumbersome adjustments depending on states of the media.

An aspect of the invention is a medium conveyance device that includes: a first conveyance unit that applies a first conveyance force in a conveyance direction to a lowest medium among media on a medium stacker; a second conveyance unit disposed downstream in the conveyance direction of the first conveyance unit and that applies a second conveyance force in the conveyance direction to the medium being conveyed in the conveyance direction; a detector that detects that a rear end of the lowest medium receiving the first conveyance force passes through the first conveyance unit; and a controller that controls the first and second conveyance units. Upon determining that the rear end of the lowest medium receiving the first conveyance force passes through the first conveyance unit, the controller switches the first conveyance unit from a conveyance state of applying the first conveyance force to a non-conveyance state of not applying the first conveyance force.

According to this aspect of the invention, the medium conveyance device can reliably convey the lowest medium one by one among stacked media without requiring cumbersome adjustments depending on states of the media.

DETAILED DESCRIPTION OF EMBODIMENTS

Figure 1:
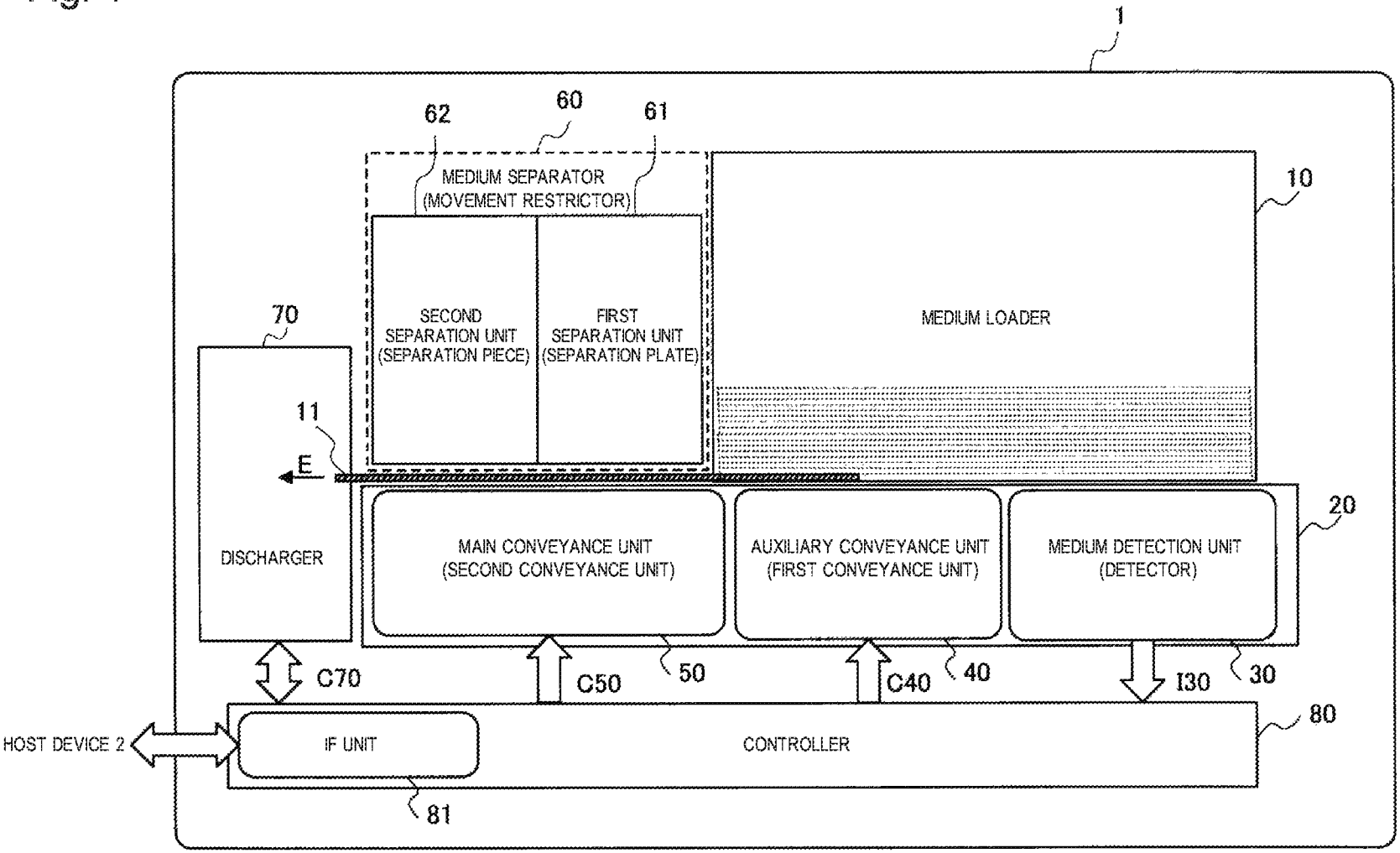
FIG. 1 is a diagram schematically illustrating a configuration of a medium conveyance device according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

<<1>> First Embodiment

<<1-1>> Configuration

FIG. 1 is a diagram schematically illustrating a configuration of medium conveyance device 1 according to a first embodiment of the invention. As illustrated in FIG. 1, medium conveyance device 1 includes medium conveyor 20 configured to feed a medium one by one out of media stacked on medium stacker 10, and controller 80. Each of the media is a sheet of paper, for example. Medium conveyor 20 includes: auxiliary conveyance unit (first conveyance unit) 40 configured to apply a first conveyance force in a predetermined conveyance direction E to medium 11 which is the lowest medium among the media stacked on medium stacker 10; main conveyance unit (second conveyance unit) 50 disposed downstream in the conveyance direction E of auxiliary conveyance unit 40 and configured to apply a second conveyance force in the conveyance direction E to medium 11 being conveyed in the conveyance direction; and medium detection unit (detector) 30 configured to detect that rear end 11*a* in the conveyance direction E of medium 11 passes through auxiliary conveyance unit 40. Controller 80 switches auxiliary conveyance unit 40 from a conveyance state of applying the first conveyance force to a non-conveyance state (a stopped state) of not applying the first conveyance force when controller 80 determines from a result of detection by medium detection unit 30, that rear end 11*a* in the conveyance direction E of medium 11 receiving the first conveyance force passes through auxiliary conveyance unit 40 (when controller 80 determines that rear end 11*a* is located downstream of a position of a medium sensor, for example).

In the meantime, medium conveyance device 1 preferably includes medium separator (movement restrictor) 60 and discharger (sheet delivery unit) 70. Medium separator 60 defines passage (clearance) 63 between medium separator 60 and main conveyance unit 50 to allow medium 11 to pass through passage 63. Medium separator 60 has a function to restrict movements in the conveyance direction E of the media, which are stacked on medium stacker 10 and placed on medium 11 being the medium at the bottom, and thereby to separate only medium 11 from the rest of the media thereon.

Controller 80 receives information concerning locations of the media (information on whether or not the rear end of media 11 passes through auxiliary conveyance unit 40 and a reference position, or information indicating whether or not any of the media is present) I30 from medium detection unit 30, and sends drive commands C40, C50, and C70 to auxiliary conveyance unit 40, main conveyance unit 50, and discharger 70, respectively, based on received information I30. Moreover, controller 80 includes control IF (interface) unit 81. Medium conveyance device 1 communicates with host device 2 by using control IF unit 81. For example, host device 2 is a device (such as a printer or a facsimile machine) configured to transmit a medium feed instruction signal to medium conveyance device 1 and to receive a sheet as a medium from medium conveyance device 1.

Figure 2:
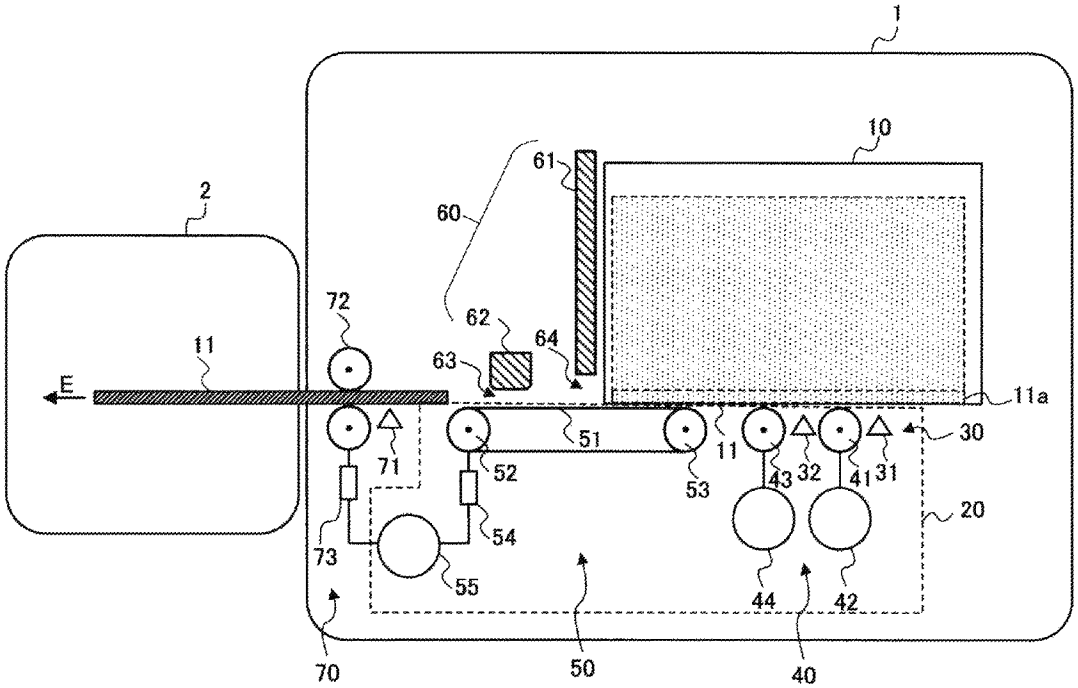
FIG. 2 is a vertical cross-sectional view schematically illustrating the configuration of the medium conveyance device according to the first embodiment.

FIG. 2 is a vertical cross-sectional view schematically illustrating a configuration of medium conveyance device 1 according to the first embodiment. In FIG. 2, constituents which are identical or correspond to the constituents illustrated in FIG. 1 are designated by the same reference numerals as those in FIG. 1.

As illustrated in FIG. 2, auxiliary conveyance unit 40 as the first conveyance unit includes first auxiliary roller 41 and second auxiliary roller 43 which come into contact with a bottom surface of medium 11, being the lowest medium among the media stacked on medium stacker 10, and apply the conveyance force in the conveyance direction E (the first conveyance force) to medium 11. Moreover, auxiliary conveyance unit 40 includes first auxiliary motor (first driver) 42 configured to rotate or stop rotation of first auxiliary roller 41, and second auxiliary motor (second driver) 44 configured to rotate or stop rotation of second auxiliary roller 43. An outer peripheral surface of each of first auxiliary roller 41 and second auxiliary roller 43 is made of a material containing a natural rubber raw material, a urethane raw material, and the like, for example. Although FIG. 2 illustrates the example in which auxiliary conveyance unit 40 includes first auxiliary roller 41 and second auxiliary roller 43, auxiliary conveyance unit 40 may include one auxiliary roller or three or more auxiliary rollers instead.

As illustrated in FIG. 2, medium detection unit 30 includes: first medium sensor 31 disposed at a first reference position located upstream in the conveyance direction E of first auxiliary roller 41 and configured to detect a state of medium 11 at the first reference position to which the first conveyance force is applied; and second medium sensor 32 disposed at a second reference position between first auxiliary roller 41 and second auxiliary roller 43 and configured to detect a state of medium 11 at the second reference position to which the first conveyance force is applied. Controller 80 can determine the position of medium 11 by using results of the detection by first medium sensor 31 and second medium sensor 32.

Each of first medium sensor 31 and second medium sensor 32 is a displacement sensor which detects a change in position of a detection target at the first reference position or the second reference position, for example. The displacement sensor is, for example, an optical sensor which detects the displacement of the detection target by measuring a change in time between a point of emission of a laser beam onto the medium and a point of reception of the laser beam reflected from the medium. Alternatively, the displacement sensor may be a mechanical sensor which detects the displacement of the detection target by bringing a measurement probe into contact with the bottom surface of the medium and measuring a change in position of the medium when the medium is conveyed. First medium sensor 31 and second medium sensor 32 may be sensors of other types as long as such sensors can detect the passage of rear end 11*a* of medium 11.

Medium conveyance device 1 includes medium stacker (sheet container) 10 which contains the media stacked thereon. Moreover, as main conveyance unit 50, medium conveyance device 1 includes: conveyance belt 51 which applies a second conveyance force in the conveyance direction E to the medium out of the media stacked on the medium stacker 10, the medium being conveyed in the conveyance direction; conveyance belt rollers 52 and 53 on which conveyance belt 51 is wound; hopping clutch 54 which switches between stop and drive of conveyance belt rollers 52 and 53; and hopping motor (third driver) 55 which rotates conveyance belt rollers 52 and 53. Hopping clutch 54 transmits a driving force generated by hopping motor 55 to conveyance belt roller 52, thereby rotating conveyance belt roller 52 and thus rotating conveyance belt 51 (establishing a conveyance state). Meanwhile, hopping clutch 54 refrains from transmitting the driving force generated by hopping motor 55 to conveyance belt roller 52, thereby stopping conveyance belt 51 (establishing a non-conveyance state).

Moreover, medium conveyance device 1 includes discharger 70. Discharger 70 includes medium sensor 71, paired registration rollers 72 which send medium 11 out to host device 2; and registration clutch 73 which switches between stop and drive of registration rollers 72. Here, the driving force of hopping motor 55 is also transmitted to paired registration rollers 72 via registration clutch 73. Accordingly, hopping motor 55 also has a function as discharger 70. Meanwhile, medium sensor 71 is configured to detect whether or not the medium being conveyed is located at a detecting position. Accordingly, medium sensor 71 also has a function as medium detection unit 30. Medium sensor 71 is used for detecting that front end 11*b* of medium 11 passes through the detecting position for medium sensor 71.

Medium conveyance device 1 includes medium separator (movement restrictor) 60. Medium separator 60 includes separation plate 61 as a first separation unit, and a separation piece 62 as a second separation unit. Separation plate 61 is disposed in such away as to be opposed to conveyance belt 51 while defining a first distance, which is an distance of passage (clearance) 64, between separation plate 61 and conveyance belt 51. Passage 64 has the distance that enables some media to pass therethrough. Separation piece 62 is disposed downstream in the conveyance direction of separation plate 61 and in such a way as to be opposed to conveyance belt 51 while defining a second distance, which is the distance of passage 63, between separation piece 62 and conveyance belt 51. The distance of passage 63 is narrower than the distance of passage 64, and enables only one medium to pass therethrough. For example, passage 64 defined by separation plate 61 is adjusted to a thickness in a range from twice to five times as large as a thickness of each medium so that some (two to five, for example) lowest media among the media stacked on medium stacker 10 can pass through passage 64. Meanwhile, the distance of passage 63 defined by separation piece 62 is adjusted to a value which is greater than the thickness of each medium but smaller than twice the thickness of each medium, so that the medium being conveyed in the conveyance direction can pass therethrough. In other words, an distance between conveyance belt 51 of second conveyance unit 50 and a bottom surface of separation piece 62 being apart of movement restrictor 60 located closest to conveyance belt 51 is adjusted to the value greater than the thickness of each medium but smaller than twice the thickness of each medium. Nonetheless, medium separator 60 does not always have to be formed from the two components (separation plate 61 and separation piece 62), and may be formed from a single component or three or more components instead.

Meanwhile, controller 80 of medium conveyance device 1 is formed from a control circuit, for example. Controller 80 drives or stops first auxiliary motor 42, second auxiliary motor 44, and hopping motor 55 based on information received from first medium sensor 31, second medium sensor 32, and medium sensor 71. Each of motors 42, 44, and 55 is a stepping motor, for example. In the meantime, controller 80 turns hopping clutch 54 and registration clutch 73 on (for connection) and off (for disconnection). Here, each of hopping clutch 54 and registration clutch 73 may adopt any mechanism as long as such a mechanism can switch between a state of transmitting the driving force of hopping motor 55 and a state of not transmitting the driving force thereof.

An distance between conveyance belt roller 53 and second auxiliary roller 43 is in a range from 50 mm to 70 mm, for example. An distance between second auxiliary roller 43 and first auxiliary roller 41 is in a range from 40 mm to 60 mm, for example. An distance between conveyance belt roller 53 and second medium sensor 32 is in a range from 20 mm to 35 mm, for example. An distance between second auxiliary roller 43 and second medium sensor 32 is in a range from 20 mm to 35 mm, for example. An distance between first auxiliary roller 41 and first medium sensor 31 is in a range from 20 mm to 35 mm, for example. However, the invention is not limited to the above-mentioned configurations and can be modified as appropriate depending on the medium type. The medium type subjected to the conveyance by the medium conveyance device applying the invention includes, but is not limited to, sheets of paper, name cards, postcards, envelopes, and the like. Further, the number of the auxiliary rollers is not limited to two, and the medium sensors are not limited only to the two sensors of the first medium sensor and the second medium sensor. The numbers of the auxiliary rollers and the medium sensors may be set to three or more depending on the medium type, for example.

<<1-2>> Operations

FIGS. 3A to 3D are diagrams illustrating operations of medium conveyance device 1 according to the first embodiment. In FIGS. 3A to 3D, constituents which are identical or correspond to the constituents illustrated in FIG. 2 are designated by the same reference numerals as those in FIG. 2. As illustrated in FIGS. 3A to 3D, the position of separation plate 61 relative to conveyance belt 51 is adjusted in such a way as to define passage 64 that allows some (about two) stacked media to pass therethrough. Meanwhile, the position of separation piece 62 relative to conveyance belt 51 is adjusted in such a way as to define passage 63 that allows a single medium to pass therethrough.

Figure 3A:
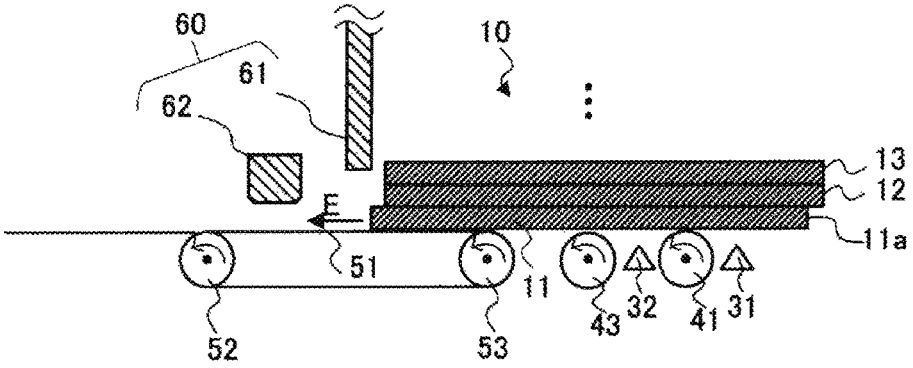
FIGS. 3A to 3D are diagrams illustrating operations of the medium conveyance device according to the first embodiment.

Medium conveyance device 1 starts the conveyance of the medium by driving first auxiliary roller 41, second auxiliary roller 43, and conveyance belt 51. By rotation of first auxiliary roller 41, second auxiliary roller 43, and conveyance belt 51 as illustrated in FIG. 3A, the conveyance force is applied to medium 11 which is the lowest medium among the media stacked on medium stacker 10. Thus, medium 11 is conveyed in the conveyance direction E. Some media (such as media 12 and 13) that are stacked on medium 11 move in the conveyance direction E together with medium 11.

Figure 3B:
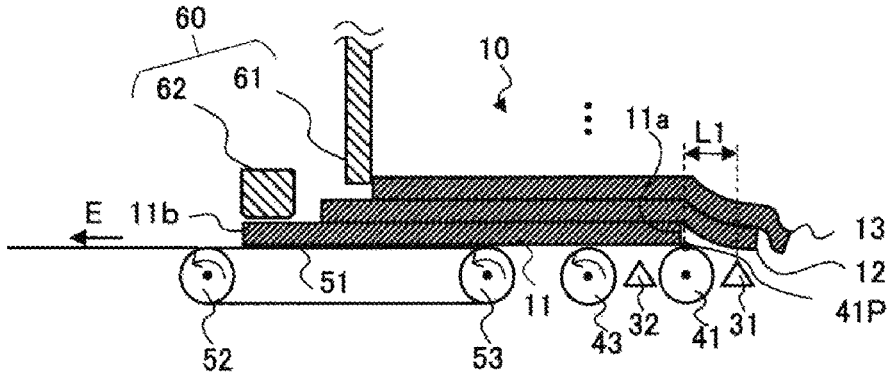

As illustrated in FIG. 3B, medium 11 and medium 12 located thereon move in the conveyance direction E while passing through passage 64 defined by separation plate 61. As illustrated in FIG. 3B, medium 13, which is the third medium from the bottom, is not conveyed in the conveyance direction E because separation plate 61 restricts its movement in the conveyance direction E. After first medium sensor 31 detects rear end 11*a* of medium 11 (after the conveyance of medium 11 over a distance L1 following the detection of rear end 11*a*, for example), controller 80 stops first auxiliary motor 42 so as to switch first auxiliary roller 41 from the conveyance state of being rotated and applying the conveyance force to the non-conveyance state of not being rotated and not applying the conveyance force.

Figure 3C:
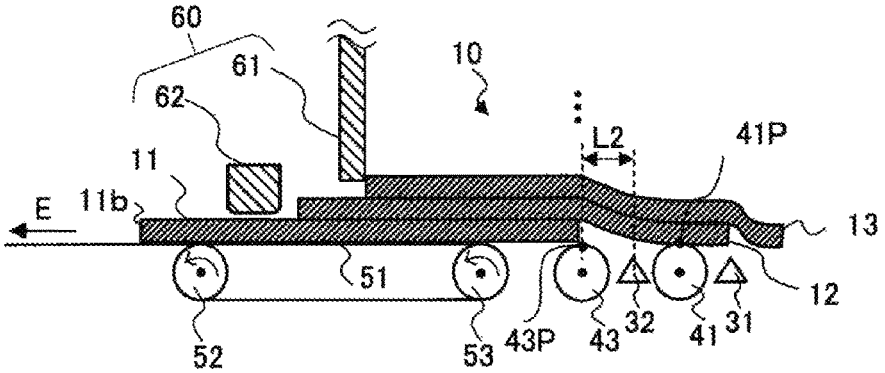

As illustrated in FIG. 3C, medium 11 passes through passage 63 defined by separation piece 62. In the meantime, medium 12 moves in the conveyance direction E together with medium 11. Here, first auxiliary roller 41 is in contact with contact point 41P on a bottom surface of medium 12 after the passage of medium 11. Since first auxiliary roller 41 stops the rotation at this point, medium 12 does not receive the conveyance force in the conveyance direction E from first auxiliary roller 41. Meanwhile, first auxiliary roller 41 in the non-conveyance state is not rotated by a force received from the stacked media. As a consequence, if medium 12 attempts to move in the conveyance direction E together with medium 11, medium 12 receives a force from contact point 41P in an opposite direction to the conveyance direction E. As described above, first auxiliary roller 41 in the non-conveyance state functions as a brake to prevent the media other than medium 11 from moving in the conveyance direction E. Accordingly, even when medium 12 moves in the conveyance direction E together with medium 11, a distance of movement of medium 12 becomes smaller than a distance of movement of medium 11. Here, the conveyance force in the conveyance direction E from medium 12 to be received by the medium located on medium 12 also becomes small. Thus, the medium located on medium 12 is prevented from entering the gap between separation plate 61 and medium 12.

After second medium sensor 32 detects rear end 11*a* of medium 11 (after the conveyance of medium 11 over a distance L2 following the detection of rear end 11*a*, for example), medium conveyance device 1 stops second auxiliary motor 44 so as to switch second auxiliary roller 43 from the conveyance state of being rotated and to the non-conveyance state of not being rotated by changing the conveyance force and not applying the conveyance force.

Figure 3D:
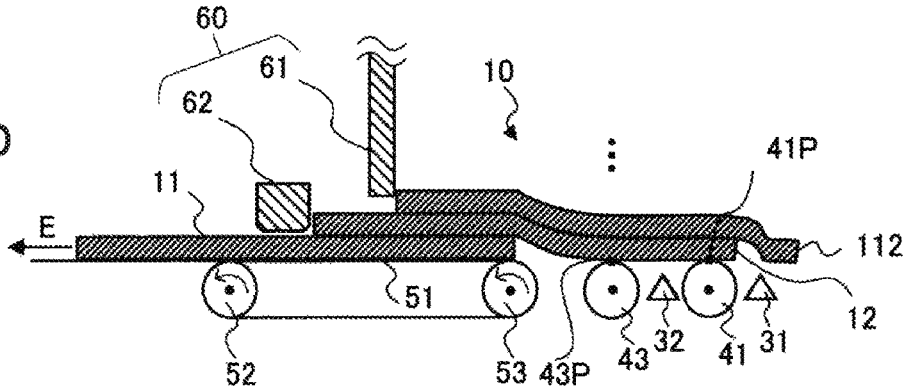

As illustrated in FIG. 3D, medium 11 is conveyed toward registration rollers 72 of discharger 70. Meanwhile, after the passage of medium 11, contact point 43P of second auxiliary roller 43 is in contact with the bottom surface of medium 12. Here, since second auxiliary roller 43 stops the rotation at this point, medium 12 does not receive the conveyance force in the conveyance direction E from second auxiliary roller 43. Meanwhile, second auxiliary roller 43 in the non-conveyance state is not rotated by the force received from the stacked media. As a consequence, if medium 12 attempts to move in the conveyance direction E together with medium 11, medium 12 receives a force from contact point 43P in the opposite direction to the conveyance direction E. As described above, as with first auxiliary roller 41 in the non-conveyance state, second auxiliary roller 43 in the non-conveyance state functions as a brake to prevent the media other than medium 11 from moving in the conveyance direction E.

As described above, when medium 12 stacked on medium 11 passes through passage 64 defined by separation plate 61, the conveyance force in the conveyance direction E to be received by medium 12 is limited since first auxiliary roller 41 and second auxiliary roller 43 are in the non-conveyance state. The sufficient conveyance force for allowing medium 12 to pass through the gap between medium 11 and separation piece 62 does not act on medium 12. For this reason, by using separation piece 62, medium conveyance device 1 can restrict the movement in the conveyance direction E of medium 12 stacked on medium 11, and reliably convey medium 11 only.

Figure 4:
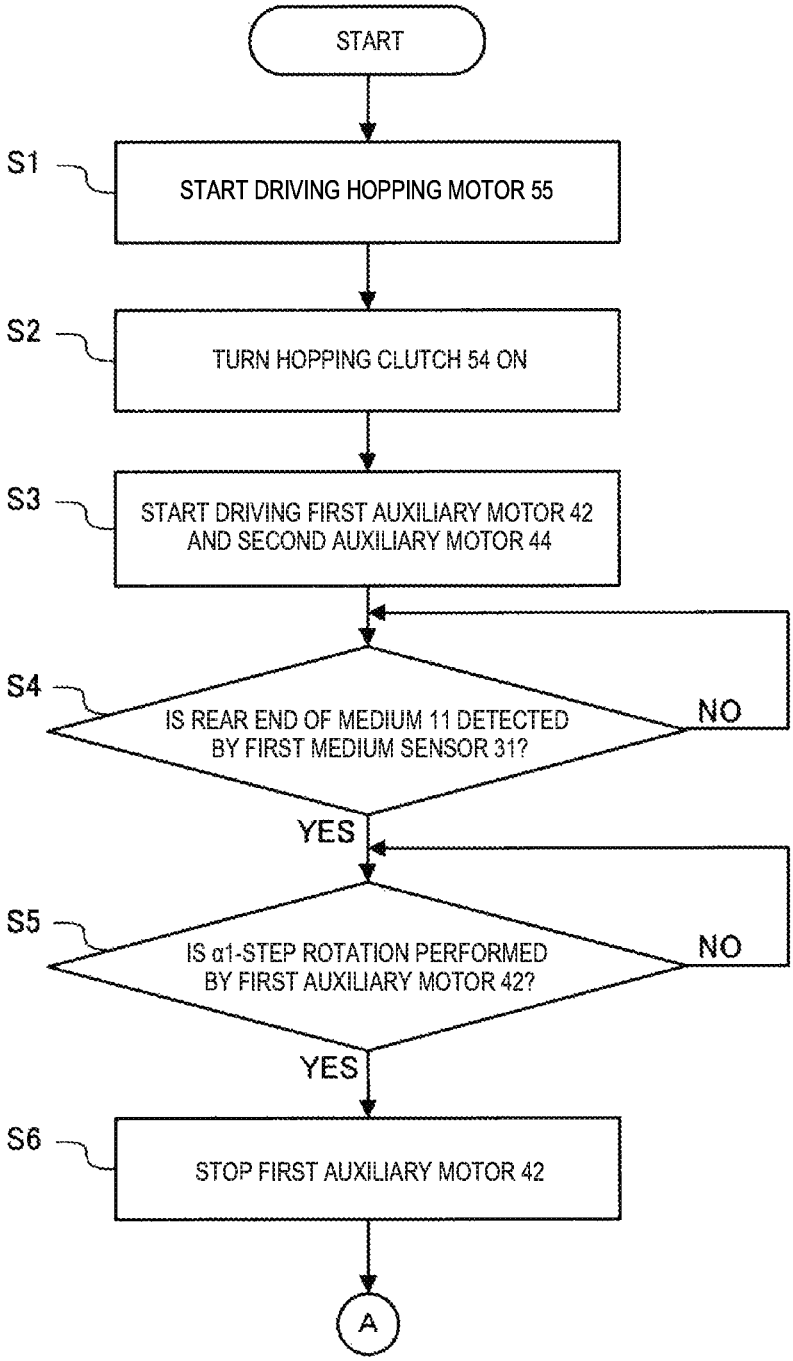
FIG. 4 is a flowchart illustrating the operations of the medium conveyance device according to the first embodiment.
Figure 5:
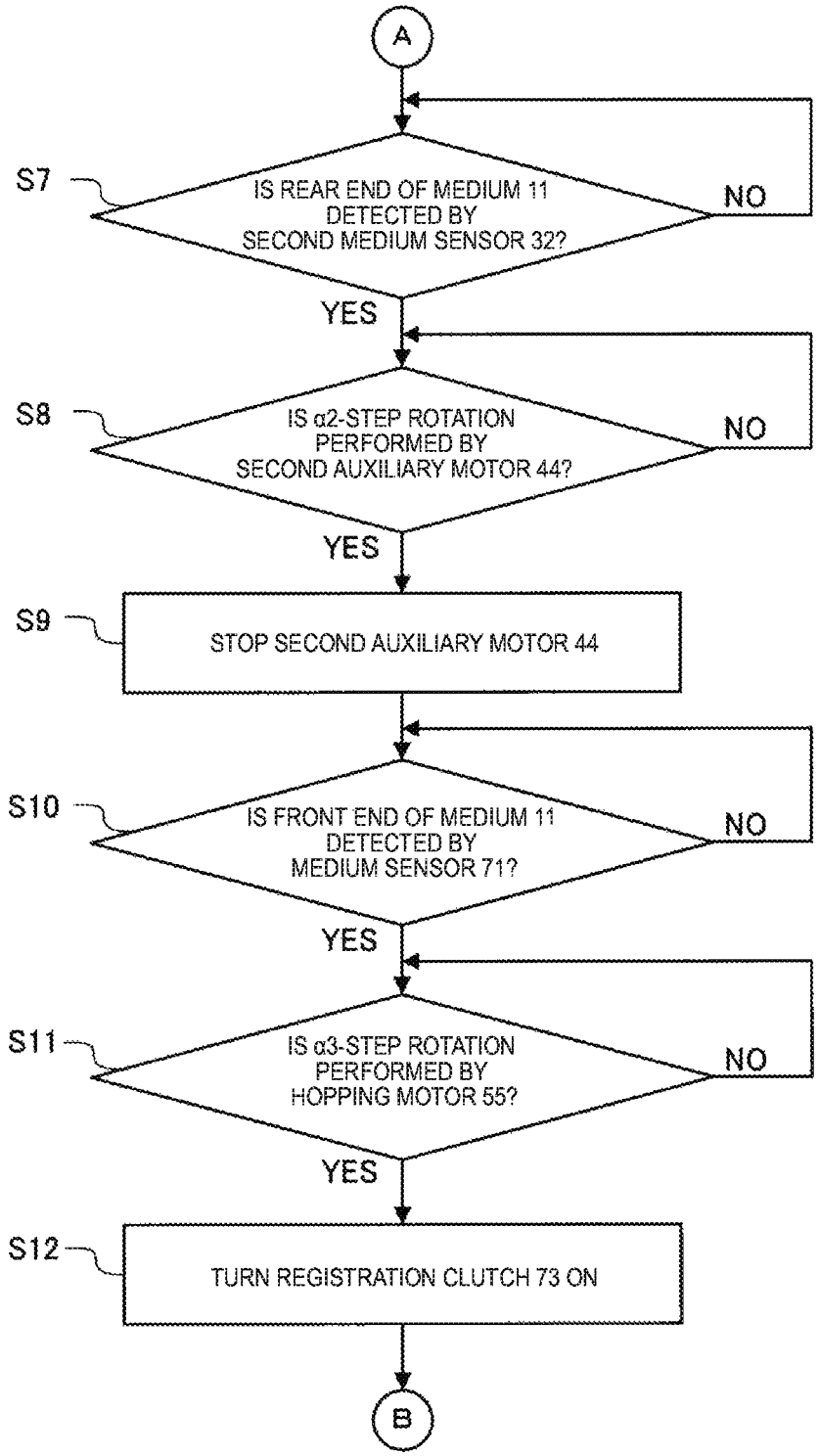
FIG. 5 is a flowchart illustrating the operations (the operations subsequent to FIG. 4) of the medium conveyance device according to the first embodiment.
Figure 6:
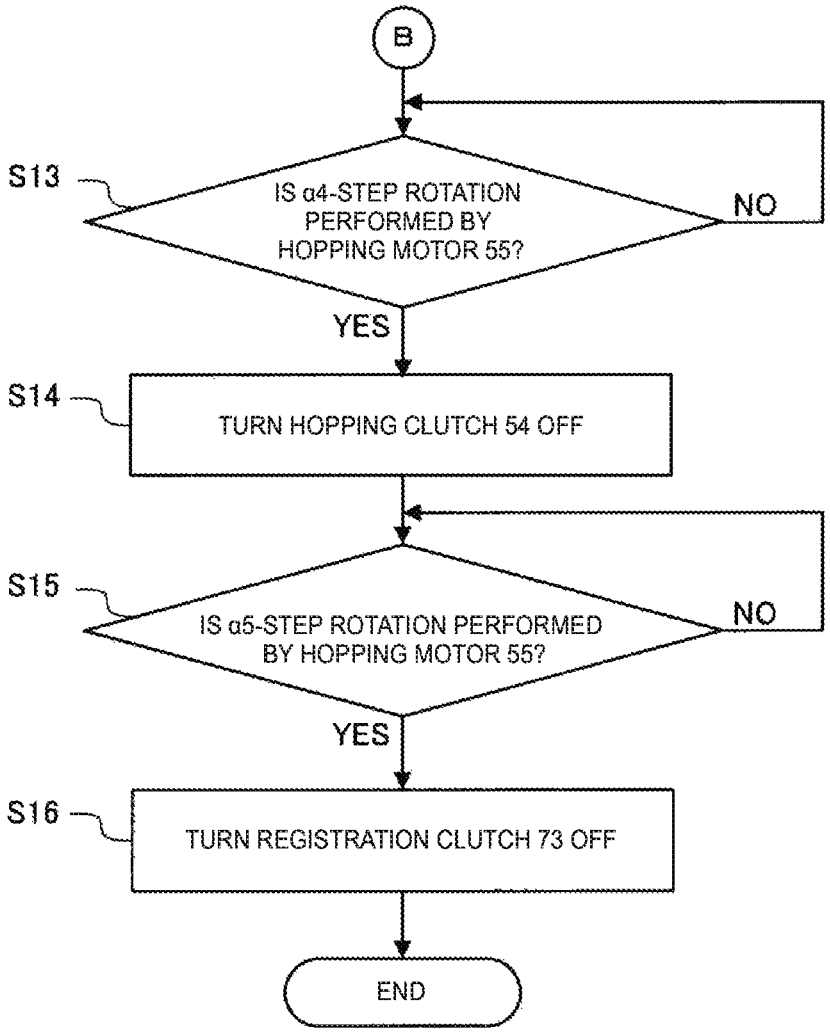
FIG. 6 is a flowchart illustrating the operations (the operations subsequent to FIG. 5) of the medium conveyance device according to the first embodiment.

FIGS. 4 to 6 are flowcharts illustrating the operations of medium conveyance device 1 according to the first embodiment. FIGS. 4 to 6 illustrate the processing from a start of the conveyance of medium 11 by medium conveyance device 1 to the completion of the conveyance. In the following description, references are also made to FIGS. 1 to 3D.

FIG. 4 illustrates the processing from the start of the conveyance of medium 11 to a stop of the drive of first auxiliary roller 41. Upon receipt of a sheet feeding command sent from host device 2, controller 80 drives hopping motor 55 (step S1). Controller 80 turns hopping clutch 54 on (step S2), and rotates conveyance belt 51. Meanwhile, controller 80 starts the drive of first auxiliary motor 42 and second auxiliary motor 44 (step S3), thereby rotating first auxiliary roller 41 and second auxiliary roller 43. Thus, controller 80 causes first auxiliary roller 41, second auxiliary roller 43, and conveyance belt 51 to convey medium 11 in the conveyance direction E.

When first medium sensor 31 detects rear end 11*a* of medium 11 (YES in step S4), controller 80 determines whether or not first auxiliary motor 42 performed α1-step rotation (rotation of the number of steps equal to α1) (step S5). The α1-step rotation corresponds to the distance L1 illustrated in FIG. 3B, for example. In this way, from a result of the detection by first medium sensor 31, controller 80 can determine that rear end 11*a* of medium 11 passed through the first reference position where first medium sensor 31 is disposed, and is located downstream of the first reference position. After first auxiliary motor 42 performed the α1-step rotation, controller 80 stops the drive of first auxiliary motor 42 (step S6), and stops the rotation of first auxiliary roller 41. Controller 80 establishes the non-conveyance state of first auxiliary roller 41, and causes second auxiliary roller 43 and conveyance belt 51 to convey medium 11 in the conveyance direction E.

FIG. 5 illustrates the processing to the point where controller 80 drives registration rollers 72. When second medium sensor 32 detects rear end 11*a* of medium 11 (YES in step S7), controller 80 determines whether or not second auxiliary motor 44 performed α2-step rotation (rotation of the number of steps equal to α2) (step S8). The α2-step rotation corresponds to the distance L2 illustrated in FIG. 3C, for example. In this way, from a result of the detection by second medium sensor 32, controller 80 can determine that rear end 11*a* of medium 11 passed through the second reference position where second medium sensor 32 is disposed, and is located downstream of the second reference position. After second auxiliary motor 44 performed the α2-step rotation, controller 80 stops the drive of second auxiliary motor 44 (step S9), and stops the rotation of second auxiliary roller 43. Controller 80 establishes the non-conveyance state of second auxiliary roller 43, and causes conveyance belt 51 to convey medium 11 in the conveyance direction E.

As medium 11 is conveyed, medium sensor 71 detects that front end 11*b* of medium 11 passes above medium sensor 71 (YES in step S10). When medium sensor 71 detects front end 11*b* of medium 11, controller 80 determines whether or not hopping motor 55 performed α3-step rotation (rotation of the number of steps equal to α3) (step S11). After hopping motor 55 performed the α3-step rotation, controller 80 turns registration clutch 73 on (step S12), and rotates registration rollers 72. Controller 80 causes conveyance belt 51 and registration rollers 72 to convey medium 11 in the conveyance direction E.

FIG. 6 illustrates the processing to the point where controller 80 conveys medium 11 to host device 2. Controller 80 determines whether or not hopping motor 55 performed α4-step rotation (rotation of the number of steps equal to α4) (step S13). After hopping motor 55 performed the α4-step rotation, controller 80 turns hopping clutch 54 off (step S14), and stops the drive of conveyance belt 51. Controller 80 causes registration rollers 72 to convey medium 11 in the conveyance direction E.

After turning hopping clutch 54 off, controller 80 determines whether or not hopping motor 55 performed α5-step rotation (rotation of the number of steps equal to α5) (step S15). After hopping motor 55 performed the α5-step rotation, controller 80 turns registration clutch 73 off (step S16), and stops the rotation of registration rollers 72. Thus, medium. 11 is conveyed from medium conveyance device 1 to host device 2.

The respective values of α1, α2, α3, α4, and α5 indicating the numbers of steps corresponding to rotational angles are determined based on the size of the medium, the distance between medium sensor 71 and conveyance belt 51, a friction coefficient between conveyance belt 51 and the medium, and the like.

In the above description, the timings to stop first auxiliary roller 41 and second auxiliary roller 43 are determined while designating the timings of the detection of rear end 11*a* of medium 11 by first medium sensor 31 and second medium sensor 32 as starting points, respectively. However, the invention is not limited to this configuration. The invention may also be configured to receive information on the length of the medium from host device 2, to calculate the timings at which rear end 11*a* of medium 11 will pass through the first reference position and the second reference position based on the information on the length of the medium, and further to stop first auxiliary motor 42 and second auxiliary motor 44 after each of first auxiliary motor 42 and second auxiliary motor 44 performed rotation in a certain number of steps. In this case, first medium sensor 31 and second medium sensor 32 may be omitted.

<<1-3>> Effects

As described above, medium conveyance device 1 according to the first embodiment stops the rotation of first auxiliary roller 41 after first medium sensor 31 detects rear end 11*a* of medium 11, and stops the rotation of second auxiliary roller 43 after second medium sensor 32 detects rear end 11*a* of medium 11. As a consequence, even when medium 12 on medium 11 comes into contact with first auxiliary roller 41 and second auxiliary roller 43, medium 12 does not receive the conveyance force in the conveyance direction E from first auxiliary roller 41 or second auxiliary roller 43. Meanwhile, first auxiliary roller 41 and second auxiliary roller 43 in the non-conveyance state are not rotated by the force received from the stacked media. Accordingly, when medium 12 attempts to move in the conveyance direction E together with medium 11, medium 12 receives the force in the opposite direction to the conveyance direction E from contact points 43P and 41P as a consequence. As described above, the conveyance force in the conveyance direction E received by medium 12 is restricted. Accordingly, medium conveyance device 1 can convey and discharge only medium 11 being the lowest medium among the stacked media, without performing cumbersome adjustments of separation plate 61, separation piece 62, and the like. Thus, medium conveyance device 1 can reliably prevent the media stacked on medium 11 from being discharged.

<<2>> Second Embodiment

<<2-1>> Configuration

Figure 7:
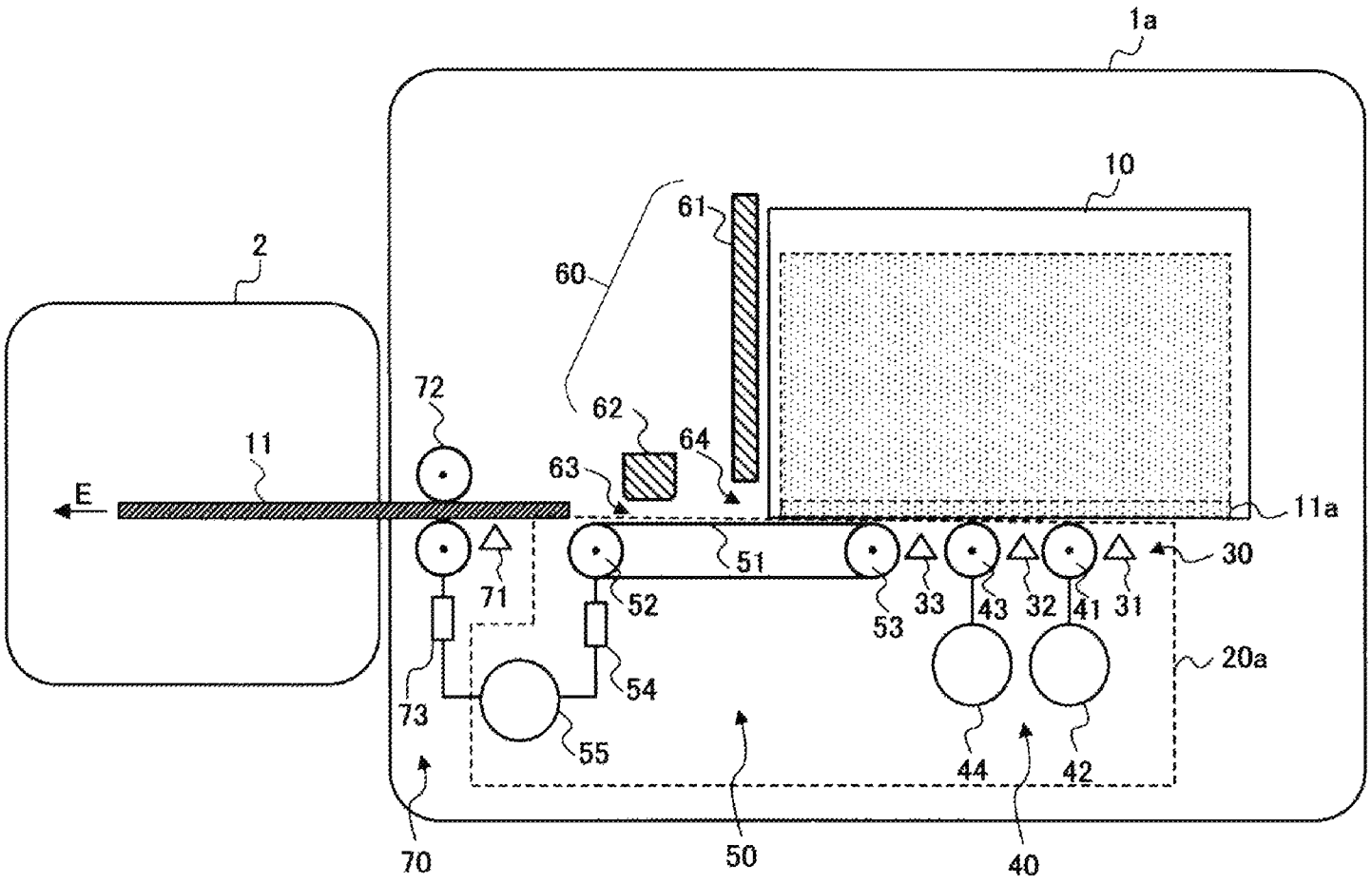
FIG. 7 is a vertical cross-sectional view schematically illustrating a configuration of a medium conveyance device according to a second embodiment of the invention.

FIG. 7 is a vertical cross-sectional view schematically illustrating a configuration of medium conveyance device 1*a* according to a second embodiment of the invention. In FIG. 7, constituents which are identical or corresponding to the constituents illustrated in FIG. 2 are designated by the same reference numerals as those in FIG. 2. As illustrated in FIG. 7, medium conveyance device 1*a* according to the second embodiment is different from medium conveyance device 1 according to the first embodiment. Medium conveyance device 1*a* includes medium conveyor 20*a*, which is provided with a third medium sensor 33 disposed at a third reference position between conveyance belt 51 and second auxiliary roller 43. Third medium sensor 33 is configured to detect whether or not a medium is present at the third reference position. Each of conveyance belt 51, second auxiliary roller 43, and first auxiliary roller 41 is determined to be driven depending on a length in the conveyance direction E of the media stacked on medium stacker 10. Other features of medium conveyance device 1*a* according to the second embodiment are the same as those of medium conveyance device 1 according to the first embodiment. Therefore, reference is also made to FIG. 1 in the description of the second embodiment.

<<2-2>> Operations

Figure 8A:
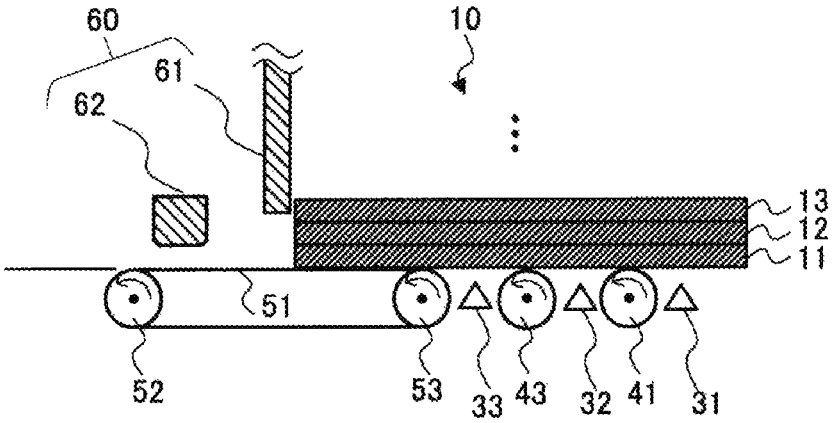
FIGS. 8A to 8C are vertical cross-sectional views schematically illustrating states of the medium conveyance device according to the second embodiment.
Figure 8B:
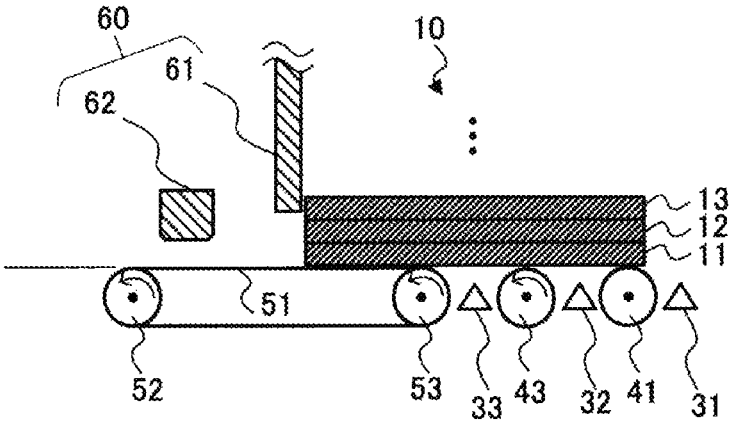
Figure 8C:
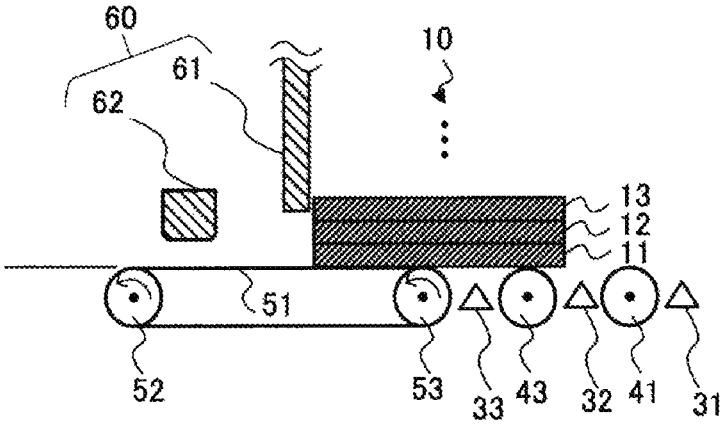

FIGS. 8A to 8C are vertical cross-sectional views schematically illustrating states of medium conveyance device 1*a* according to the second embodiment. FIG. 8A illustrates a state in which media 11 to 13 having a large medium length are stacked (set) on medium stacker 10. FIG. 8B illustrates a state in which media 11 to 13 having a medium length shorter than the length in FIG. 8A are stacked on medium stacker 10. FIG. 8C illustrates a state in which media 11 to 13 having a medium length shorter than the length in FIG. 8B are stacked on medium stacker 10. In FIGS. 8A to 8C, constituents which are identical or corresponding to the constituents illustrated in FIGS. 3A to 3C are designated by the same reference numerals as those in FIGS. 3A to 3C.

In the case of FIG. 8A, third medium sensor 33 detects that any of the media is present at the third reference position, being its detecting position. Meanwhile, second medium sensor 32 detects that any of the media is present at the second reference position, being its detecting position, and first medium sensor 31 detects that any of the media is present at the first reference position, being its detecting position. In this case, operations of medium conveyance device 1*a* are the same as the operations of medium conveyance device 1 according to the first embodiment.

In the case of FIG. 8B, third medium sensor 33 detects that any of the media is present at the third reference position, being its detecting position. Meanwhile, second medium sensor 32 detects that any of the media is present at the second reference position, being its detecting position, and first medium sensor 31 detects that the media are not present at the first reference position, being its detecting position. In this case, the weight of the media stacked on medium stacker 10 is smaller than the weight in the case of FIG. 8A. For this reason, controller 80 can convey medium 11 in the conveyance direction E by driving conveyance belt 51 and second auxiliary roller 43 while keeping first auxiliary roller 41 stopped. Meanwhile, when medium 11 moves in the conveyance direction E and first auxiliary roller 41 comes into contact with the bottom surface of medium 12, first auxiliary roller 41 in the non-conveyance state can also function as the brake to prevent the media, other than medium 11, from moving in the conveyance direction E. Accordingly, medium conveyance device 1*a* can convey and discharge only medium 11 being the lowest medium among the stacked media, and reliably prevent the media stacked on medium 11 from being discharged.

In the case of FIG. 8C, third medium sensor 33 detects that any of the media is present at the third reference position, being its detecting position. Meanwhile, second medium sensor 32 detects that the media are not present at the second reference position, being its detecting position, and first medium sensor 31 detects that the media are not present at the first reference position, being its detecting position. In this case, the weight of the media stacked on medium stacker 10 is smaller than the weight in the case of FIG. 8B. For this reason, controller 80 can convey medium 11 in the conveyance direction E by driving conveyance belt 51 while keeping second auxiliary roller 43 and first auxiliary roller 41 stopped. Meanwhile, as with first auxiliary roller 41 in the non-conveyance state, second auxiliary roller 43 in the non-conveyance state can also function as the brake to prevent the media, other than medium 11, from moving in the conveyance direction E. Accordingly, medium conveyance device 1*a* can convey and discharge only medium 11 being the lowest medium among the stacked media, and reliably prevent the media stacked on medium 11 from being discharged.

Figure 9:
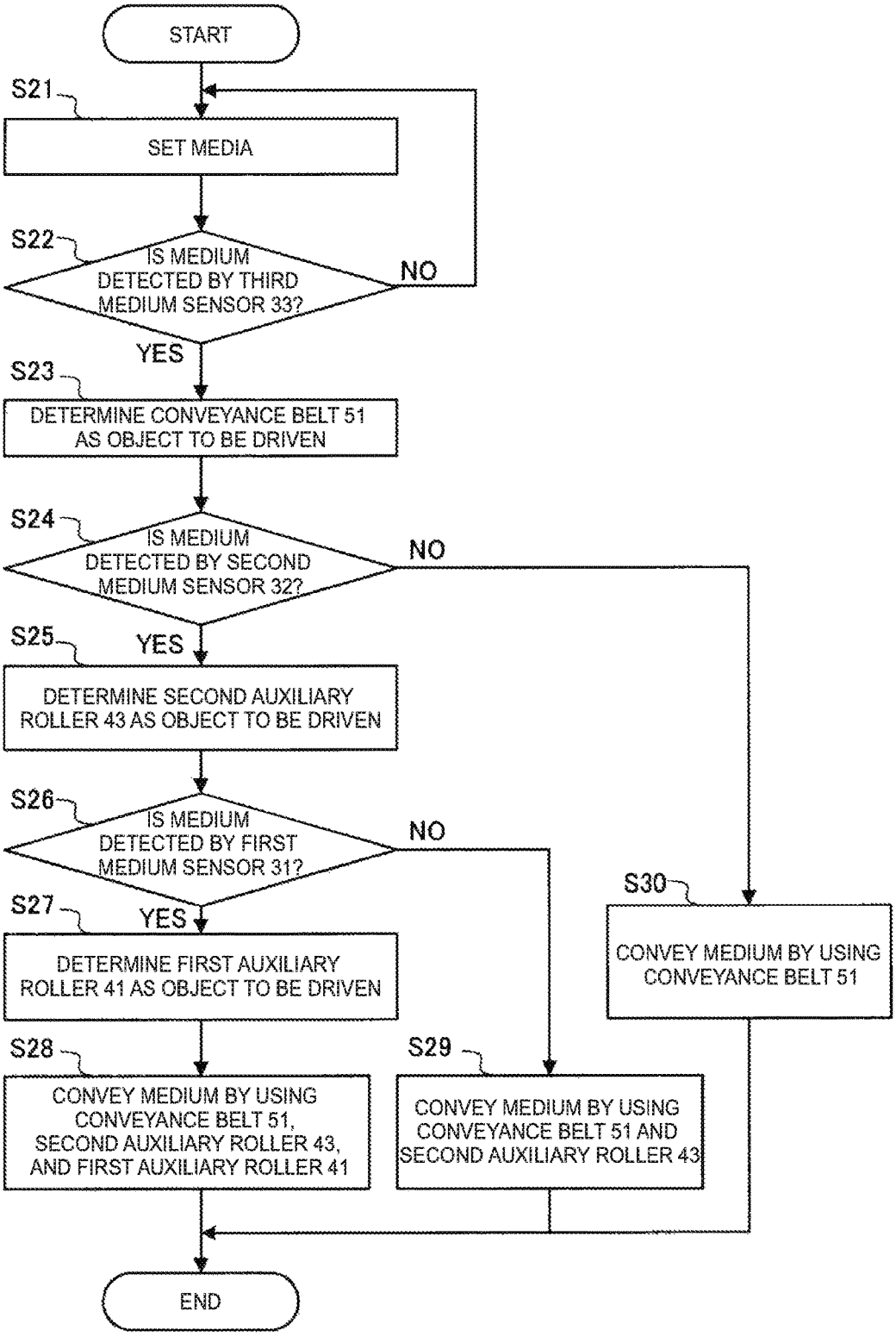
FIG. 9 is a flowchart illustrating operations of the medium conveyance device according to the second embodiment.

FIG. 9 is a flowchart illustrating operations of medium conveyance device 1*a* according to the second embodiment. Note that reference is also made to FIG. 7 and FIGS. 8A to 8C in the following description.

First, after the media are set on medium stacker 10 (step S21), controller 80 determines whether or not any of the media is present at the third reference position opposed to third medium sensor 33 based on a detection signal from third medium sensor 33 (step S22). When controller 80 determines that any of the media is present at the third reference position from a result of detection by third medium sensor 33 (YES in step S22), controller 80 determines conveyance belt 51 as an object to be driven (step S23).

Next, controller 80 determines whether or not any of the media is present at the second reference position opposed to second medium sensor 32 based on a detection signal from second medium sensor 32 (step S24). When controller 80 determines that any of the media is present at the second reference position from a result of the detection by second medium sensor 32 (YES in step S24), controller 80 determines second auxiliary roller 43 as an object to be driven (step S25) and the processing proceeds to step S26. On the other hand, when controller 80 determines that the media are not present at the second reference position from the result of the detection by second medium sensor 32 (NO in step S24), controller 80 drives conveyance belt 51 and conveys medium 11 in the conveyance direction E by using conveyance belt 51 (step S30) as illustrated in FIG. 8C.

In step S26, controller 80 determines whether or not any of the media is present at the first reference position opposed to first medium sensor 31 based on a detection signal from first medium sensor 31. When controller 80 determines that any of the media is present at the first reference position from a result of the detection by first medium sensor 31 (YES in step S26), controller 80 determines first auxiliary roller 41 as an object to be driven (step S27). Next, as illustrated in FIG. 8A, controller 80 drives conveyance belt 51, second auxiliary roller 43, and first auxiliary roller 41, and conveys medium 11 in the conveyance direction E by using conveyance belt 51, second auxiliary roller 43, and first auxiliary roller 41 (step S28). In the case of FIG. 8A, medium conveyance device 1*a* conveys medium 11 in accordance with steps S1 to step S16 as illustrated in FIGS. 4 to 6.

Meanwhile, in the case illustrated in FIG. 8B, medium conveyance device 1*a* conveys the medium in accordance with steps S7 to step S16 as illustrated in FIGS. 5 and 6.

<<2-3>> Effects

As described above, according to medium conveyance device 1*a* of the second embodiment, controller 80 determines the objects to be driven out of conveyance belt 51, second auxiliary roller 43, and first auxiliary roller 41 depending on the medium length of the media set on medium stacker 10. The conveyance force in the conveyance direction E to be received by the media is restricted depending on the medium length as described above. Accordingly, medium conveyance device 1*a* of the second embodiment can convey and discharge only medium 11 being the lowest medium among the stacked media depending on the state of the media, without performing cumbersome adjustments of separation plate 61, separation piece 62, and the like. Thus, medium conveyance device 1*a* can reliably prevent the media stacked on medium 11 from being discharged.

<<3>> Third Embodiment

<<3-1>> Configuration

Figure 10:
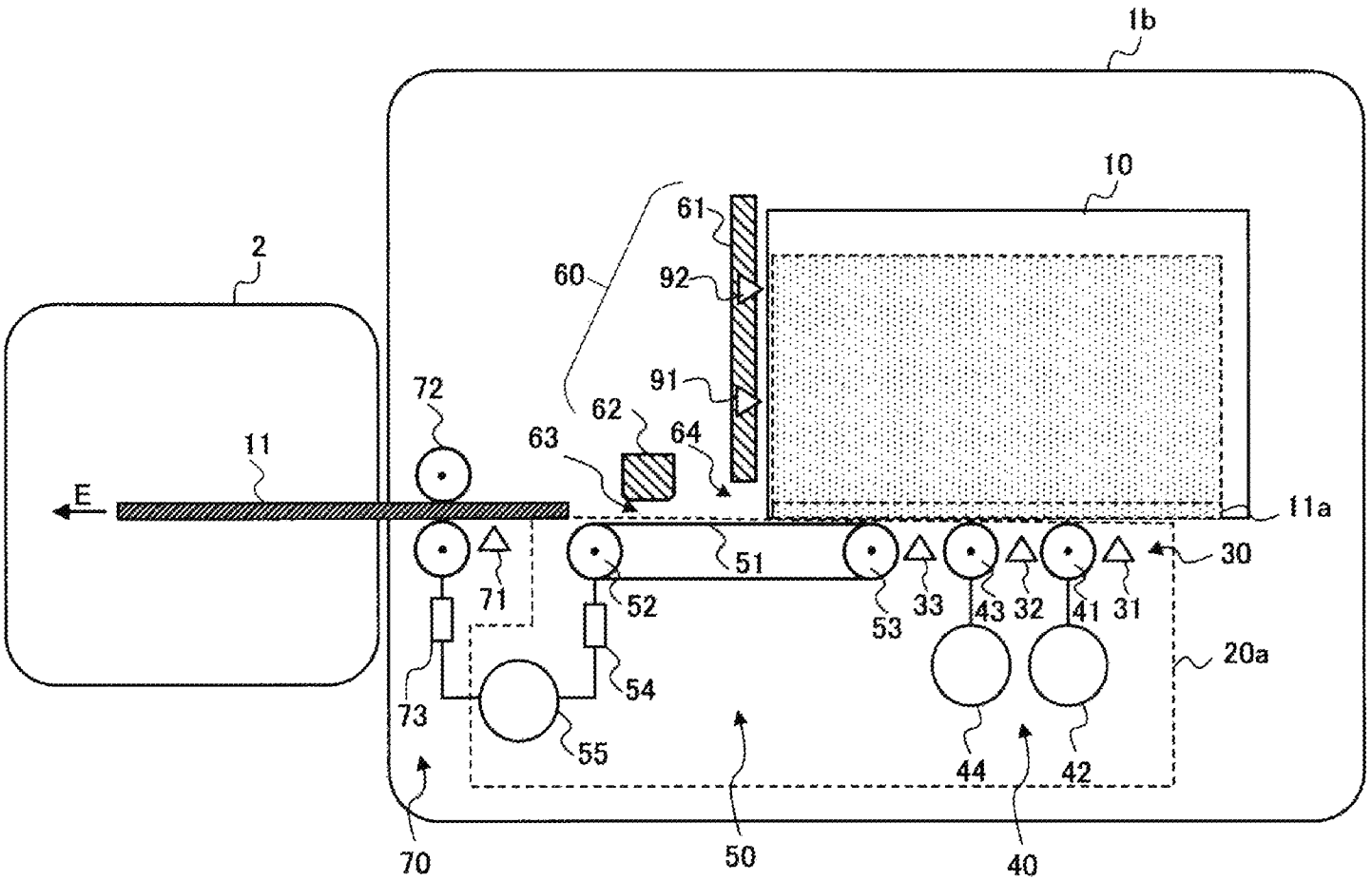
FIG. 10 is a vertical cross-sectional view schematically illustrating a configuration of a medium conveyance device according to a third embodiment of the invention.

FIG. 10 is a vertical cross-sectional view schematically illustrating a configuration of medium conveyance device 1*b* according to a third embodiment of the invention. In FIG. 10, constituents which are identical or correspond to the constituents illustrated in FIG. 7 are designated by the same reference numerals as those in FIG. 7. As illustrated in FIG. 10, medium conveyance device 1*b* according to the third embodiment is different from medium conveyance device 1*a* according to the second embodiment in that medium conveyance device 1*b* includes first height sensor 91 and second height sensor 92 each configured to detect the height of the media stacked on medium stacker 10. Each of conveyance belt 51, second auxiliary roller 43, and first auxiliary roller 41 is determined to be driven depending on the height of the media stacked on medium stacker 10. For example, first height sensor 91 and second height sensor 92 are arranged in the height direction on separation plate 61. Other features of medium conveyance device 1*b* according to the third embodiment are the same as those of medium conveyance device 1*a* according to the second embodiment. Therefore, reference is also made to FIG. 7 in the description of the third embodiment.

<<3-2>> Operations

Figure 11A:
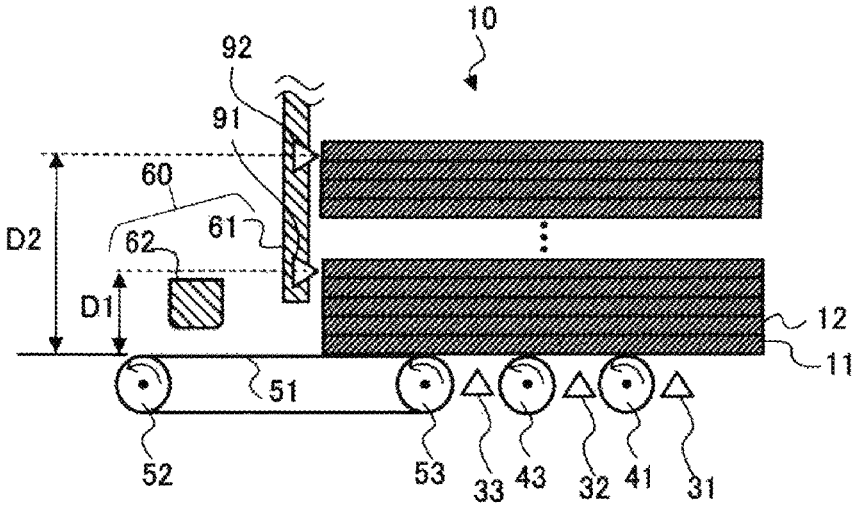
FIGS. 11A to 11C are vertical cross-sectional views schematically illustrating states of the medium conveyance device according to the third embodiment.
Figure 11B:
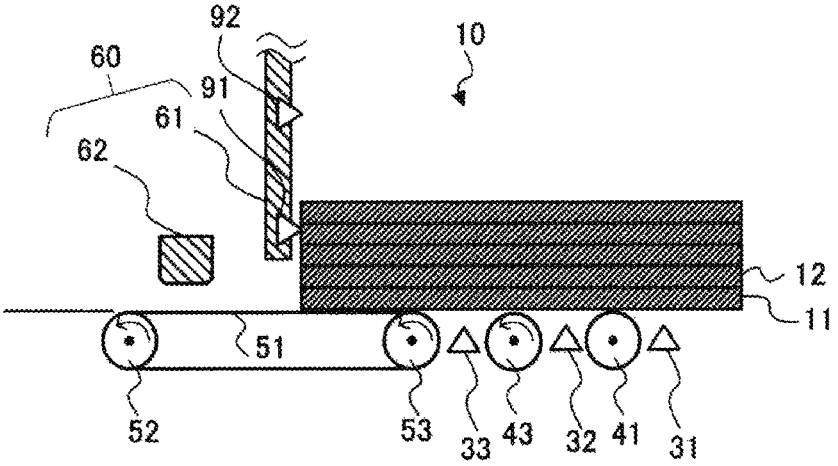
Figure 11C:
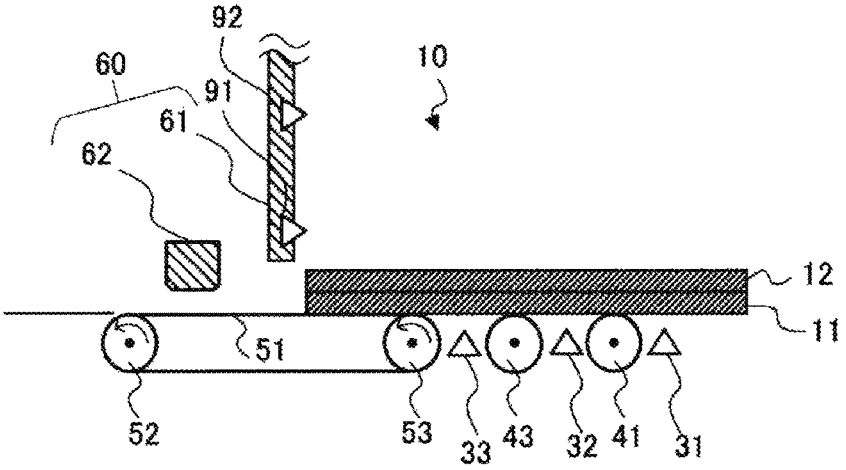

FIGS. 11A to 11C are vertical cross-sectional views schematically illustrating states of medium conveyance device 1*b* according to the third embodiment. FIG. 11A illustrates a state in which the media are stacked (set) to a position higher than a height D2 on medium stacker 10. FIG. 11B illustrates a state in which the media are stacked to a position lower than the height D2 and higher than a height D1 on medium stacker 10 (where D2>D1). FIG. 11C illustrates a state in which the media are stacked to a position lower than the height D1 on medium stacker 10. In FIGS. 11A to 11C, constituents which are identical or correspond to the constituents illustrated in FIGS. 8A to 8C are designated by the same reference numerals as those in FIGS. 8A to 8C. Although the third embodiment describes the case of providing first height sensor 91 and second height sensor 92, it is also possible to provide a single height sensor or three or more height sensors instead.

As illustrated in FIG. 11A, first height sensor 91 is disposed at a first height reference position D1 which is a position having the height D1. Second height sensor 92 is disposed at a second height reference position D2 which is a position having the height D2. In the case of FIG. 11A, first height sensor 91 detects that any of the media is present at the first height reference position, being its detecting position. Meanwhile, second height sensor 92 detects that any of the media is present at the second height reference position, being its detecting position. In this case, the weight of the media stacked on medium stacker 10 is larger than the weights in the cases of FIGS. 11B and 11C to be described below. Here, medium conveyance device 1*b* has to apply a large conveyance force to medium 11. For this reason, controller 80 of medium conveyance device 1*b* drives conveyance belt 51, second auxiliary roller 43, and first auxiliary roller 41 as in the case of the first embodiment, and conveys medium 11 in the conveyance direction E by using conveyance belt 51, second auxiliary roller 43, and first auxiliary roller 41. In this case, the operations of medium conveyance device 1*b* are the same as the operations of medium conveyance device 1 according to the first embodiment.

In the case of FIG. 11B, first height sensor 91 detects that any of the media is present at the first height reference position, being its detecting position. Meanwhile, second height sensor 92 does not detect that the media are present at the second height reference position, being its detecting position. In this case, the weight of the media stacked on medium stacker 10 is lower than the weight in the case of FIG. 11A. For this reason, controller 80 can convey medium 11 in the conveyance direction E by driving conveyance belt 51 and second auxiliary roller 43 while keeping first auxiliary roller 41 stopped. Accordingly, controller 80 conveys the medium by driving conveyance belt 51 and second auxiliary roller 43 while keeping first auxiliary roller 41 in the non-conveyance state without driving first auxiliary roller 41. Thus, by restricting the conveyance force in the conveyance direction E to be applied to the medium in advance, medium conveyance device 1*b* can convey and discharge only medium 11 being the lowest medium among the stacked media, and reliably prevent the media stacked on medium 11 from being discharged.

In the case of FIG. 11C, neither first height sensor 91 nor second height sensor 92 detects that any of the media is present at its detecting position. In this case, the weight of the media stacked on medium stacker 10 is lower than the weight in the case of FIG. 11B. For this reason, controller 80 can convey medium 11 in the conveyance direction E by driving conveyance belt 51 while keeping second auxiliary roller 43 and first auxiliary roller 41 stopped. Accordingly, controller 80 conveys the medium by driving conveyance belt 51 while keeping second auxiliary roller 43 and first auxiliary roller 41 in the non-conveyance state without driving second auxiliary roller 43 or first auxiliary roller 41. Thus, by restricting the conveyance force in the conveyance direction E to be applied to the medium in advance, medium conveyance device 1*b* can convey and discharge only medium 11 being the lowest medium among the stacked media, and reliably prevent the media stacked on medium 11 from being discharged.

Figure 12:
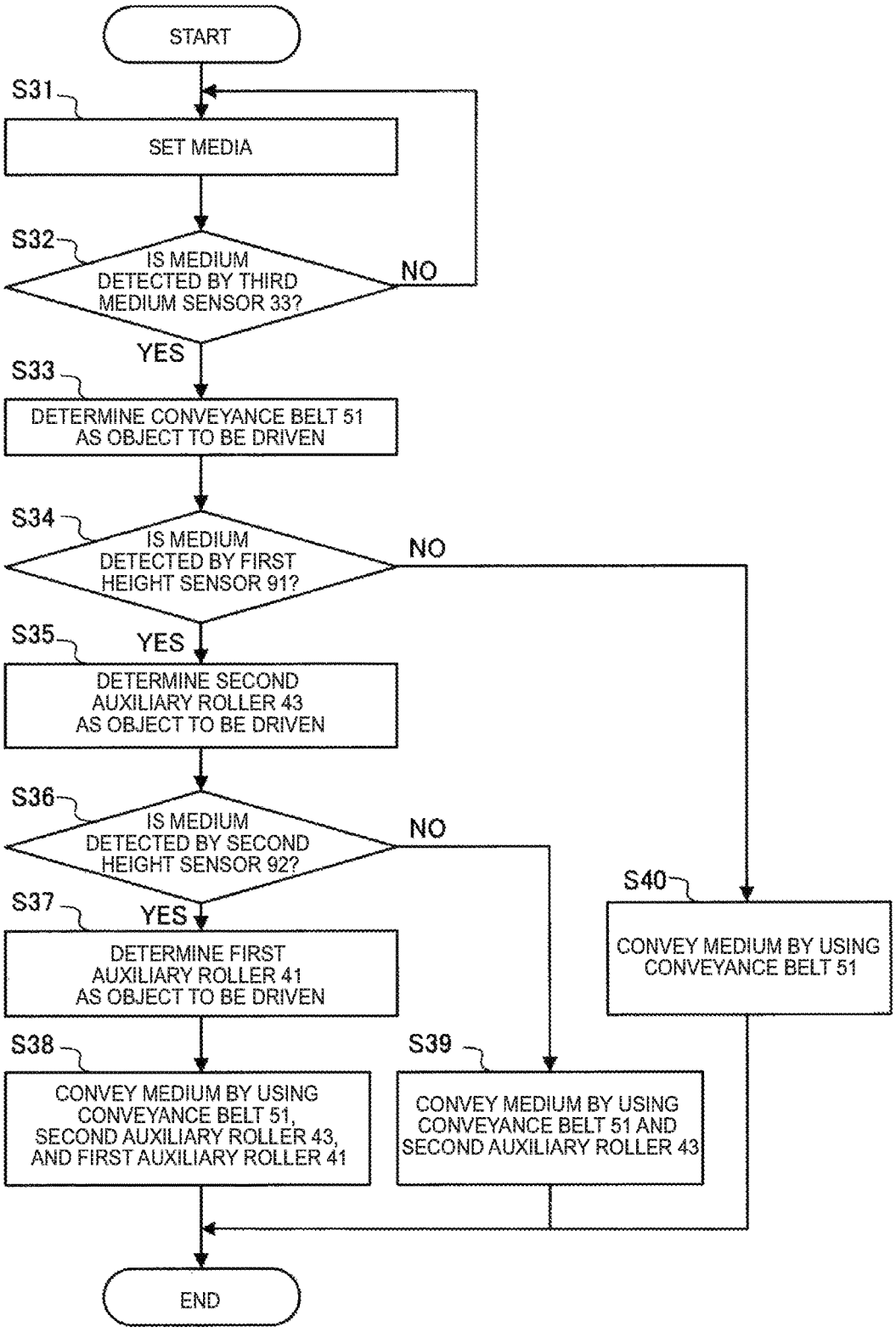
FIG. 12 is a flowchart illustrating operations of the medium conveyance device according to the third embodiment.

FIG. 12 is a flowchart illustrating operations of medium conveyance device 1*b* according to the third embodiment. Note that reference is also made to FIG. 10 and FIGS. 11A to 11C in the following description.

First, after the media are set on medium stacker 10 (step S31), controller 80 determines whether or not any of the media is present at the third reference position opposed to third medium sensor 33 based on the detection signal from third medium sensor 33 (step S32). When controller 80 determines that any of the media is present at the third reference position from the result of the detection by third medium sensor 33 (YES in step S32), controller 80 determines conveyance belt 51 as the object to be driven (step S33).

Next, controller 80 determines whether or not any of the media is present at the first height reference position opposed to first height sensor 91 based on a detection signal from first height sensor 91 (step S34). When controller 80 determines that any of the media is present at the first height reference position from a result of the detection by first height sensor 91 (YES in step S34), controller 80 determines second auxiliary roller 43 as the object to be driven (step S35), and the processing proceeds to step S36. On the other hand, when controller 80 determines that the media are not present at the first height reference position from the result of the detection by first height sensor 91 (NO in step S34), controller 80 drives conveyance belt 51 and conveys medium 11 in the conveyance direction E by using conveyance belt 51 (step S40) as illustrated in FIG. 11C.

In step S36, controller 80 determines whether or not any of the media is present at the second height reference position opposed to second height sensor 92 based on a detection signal from second height sensor 92. When controller 80 determines that any of the media is present at the second height reference position from a result of the detection by second height sensor 92 (YES in step S36), controller 80 determines first auxiliary roller 41 as the object to be driven (step S37). As illustrated in FIG. 11A, controller 80 drives conveyance belt 51, second auxiliary roller 43, and first auxiliary roller 41, and conveys medium 11 in the conveyance direction E by using conveyance belt 51, second auxiliary roller 43, and first auxiliary roller 41 (step S38). In the case of FIG. 11A, medium conveyance device 1*b* conveys medium 11 in accordance with steps S1 to step S16 as illustrated in FIGS. 4 to 6.

Meanwhile, in the case illustrated in FIG. 11B, medium conveyance device 1*b* conveys the medium in accordance with steps S7 to step S16 illustrated in FIGS. 5 and 6.

Note that the processing from steps S33 to S40 illustrated in FIG. 12 is also applicable to the case where more media are additionally stacked on medium stacker 10 while medium conveyance device 1*b* is conveying the medium.

Figure 13:
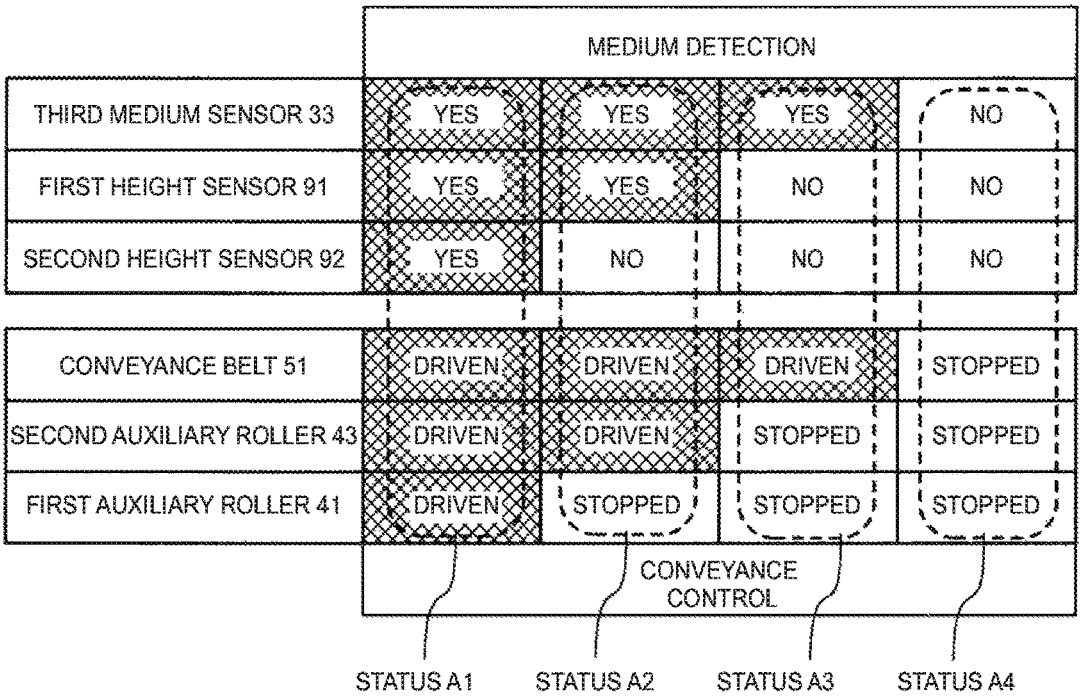
FIG. 13 is a table illustrating relations between situations of medium detection by sensors and control of conveyance units in the medium conveyance device according to the third embodiment.

FIG. 13 is a table illustrating relations between situations of medium detection by the sensors and control of conveyance units in medium conveyance device 1*b* according to the third embodiment. A status A1 illustrated in FIG. 13 indicates the case where third medium sensor 33, first height sensor 91, and second height sensor 92 detect the presence of the media. In this case, controller 80 drives conveyance belt 51, second auxiliary roller 43, and first auxiliary roller 41 as illustrated in FIG. 11A and in step S38 in FIG. 12.

As medium conveyance device 1*b* conveys the media, the number of the media stacked on medium stacker 10 is decreased and the height of the media stacked on medium stacker 10 is reduced. A status A2 illustrated in FIG. 13 indicates the case where third medium sensor 33 and first height sensor 91 detect the presence of the media, whereas second height sensor 92 does not detect the presence of the media. In this case, controller 80 stops first auxiliary roller 41, and drives conveyance belt 51 and second auxiliary roller 43 as illustrated in FIG. 11B and in step S39 in FIG. 12.

When medium conveyance device 1*b* continues the conveyance of the media, the number of the media stacked on medium stacker 10 is further decreased and the height of the stacked media is further reduced. A status A3 illustrated in FIG. 13 indicates the case where third medium sensor 33 detects the presence of the media whereas first height sensor 91 and second height sensor 92 do not detect the presence of the media. In this case, controller 80 stops first auxiliary roller 41 and second auxiliary roller 43, and drives conveyance belt 51 as illustrated in FIG. 11C and in step S40 in FIG. 12.

A status A4 illustrated in FIG. 13 indicates the case where third medium sensor 33, first height sensor 91, and second height sensor 92 do not detect the presence of the media. This case represents the situation where no media are stacked on medium stacker 10. Controller 80 stops first auxiliary roller 41, second auxiliary roller 43, and conveyance belt 51.

There may be a case where more media are additionally stacked on medium stacker 10 while medium conveyance device 1*b* is conveying the medium. For example, if the status A3 transitions to the status A1, medium conveyance device 1*b* determines first auxiliary roller 41 and second auxiliary roller 43 as the objects to be driven, and causes first auxiliary roller 41 and second auxiliary roller 43 to convey the media.

<<3-3>> Effects

As described above, according to medium conveyance device 1*b* of the third embodiment, controller 80 determines the objects to be driven out of conveyance belt 51, second auxiliary roller 43, and first auxiliary roller 41 depending on the stacked amount (the height) of the media set on medium stacker 10. The conveyance force in the conveyance direction E to be received by the media is restricted depending on the stacked amount of the media as described above. Accordingly, medium conveyance device 1*b* of the third embodiment can convey and discharge only medium 11, being the lowest medium among the stacked media, even though cumbersome adjustments of separation plate 61, separation piece 62, and the like are not performed depending on the state of the media. Thus, medium conveyance device 1*b* can reliably prevent the media stacked on medium 11 from being discharged.

<<4>> Modified Examples

Although each of medium conveyance devices 1, 1*a*, and 1*b* in the first to third embodiments is described as a device provided separately from host device 2, each of medium conveyance devices 1, 1*a*, and 1*b* may be a medium feeder constituting a part of a printer, a facsimile, or a multifunction peripheral, for example.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A medium conveyance device comprising:

a first conveyance unit that applies a first conveyance force in a conveyance direction to a lowest medium among media stacked on a medium stacker;

a second conveyance unit disposed downstream in the conveyance direction of the first conveyance unit and that applies a second conveyance force in the conveyance direction to the medium being conveyed in the conveyance direction;

a detector that includes one or more sensors disposed upstream from the second conveyance unit in the conveyance direction and configured to detect a length, along the conveyance direction, of the stacked media set in the medium stacker; and a controller that controls the first conveyance unit and the second conveyance unit, wherein based on the detected length, along the conveyance direction, of the stacked media set in the medium stacker, the controller changes the first conveyance force applied to the lowest medium, wherein the detected length of the stacked media set in the medium stacker is a length of the stacked media set in the medium stacker detected before the lowest medium in the stacked media is conveyed from the medium stacker.

2. The medium conveyance device according to claim 1, further comprising:

a movement restrictor that defines a passage between the second conveyance unit and the movement restrictor to allow the lowest medium being conveyed in the conveyance direction to pass through the passage, wherein the movement restrictor restricts a movement in the conveyance direction of a second lowest medium among the media stacked on the medium stacker, the second lowest medium being stacked on the lowest medium being conveyed in the conveyance direction.

3. The medium conveyance device according to claim 2, wherein an distance between the second conveyance unit and a part of the movement restrictor located closest to the second conveyance unit is larger than a thickness of the medium to be conveyed in the conveyance direction.

4. The medium conveyance device according to claim 3, wherein the distance between the second conveyance unit and the part of the movement restrictor located closest to the second conveyance unit is smaller than twice the thickness of the medium to be conveyed in the conveyance direction.

5. The medium conveyance device according to claim 2, wherein the movement restrictor comprises:

a first separation unit opposed to the second conveyance unit with a first distance in between: and a second separation unit disposed downstream in the conveyance direction of the first separation unit and opposed to the second conveyance unit with a second distance in between, the second distance being narrower than the first distance.

6. The medium conveyance device according to claim 1, wherein the first conveyance unit comprises:

a first auxiliary roller that applies the first conveyance force to a bottom surface of the lowest medium; and a first driver controlled by the controller and that rotates or stops rotation of the first auxiliary roller.

7. The medium conveyance device according to claim 6, wherein the one or more sensors of the detector comprises a first medium sensor disposed at a first reference position located upstream in the conveyance direction of the first auxiliary roller and that detects a state at the first reference position of the stacked media when the controller determines, based on a result of detection by the first medium sensor, that the stacked media is present at the first reference position, the controller rotates the first auxiliary roller rotated by the first driver.

8. The medium conveyance device according to claim 7, wherein when the controller determines, based on the result of detection by the first medium sensor, that the stacked media is not present at the first reference position, the controller refrains from rotating the first auxiliary roller.

9. The medium conveyance device according to claim 6, wherein the first conveyance unit comprises:

a second auxiliary roller that is provided downstream in the conveyance direction of the first auxiliary roller and applies the first conveyance force to the bottom surface of the lowest medium; and a second driver controlled by the controller and that rotates or stops rotation of the second auxiliary roller.

10. The medium conveyance device according to claim 9, wherein the one or more sensors of the detector comprises a second medium sensor disposed at a second reference position between the first auxiliary roller and the second auxiliary roller and that detects a state at the second reference position of the stacked media when the controller determines from a result of detection by the second medium sensor that the stacked media is present at the second reference position, the controller rotates the second auxiliary roller rotated by the second driver.

11. The medium conveyance device according to claim 10, wherein when the controller determines from the result of detection by the second medium sensor that the stacked media is not present at the second reference position, the controller refrains from rotating the second auxiliary roller.

12. The medium conveyance device according to claim 10, wherein the one or more sensors of the detector comprises a third medium sensor disposed at a third reference position between the second auxiliary roller and the second conveyance unit and that detects a state at the third reference position of the stacked media, and when the controller determines from a result of detection by the third medium sensor that the stacked media is present at the third reference position, the controller drives the second conveyance unit.

13. The medium conveyance device according to claim 1, wherein the second conveyance unit comprises:

a conveyance belt that applies the second conveyance force to the medium being conveyed in the conveyance direction;

conveyance belt rollers on which the conveyance belt is wound; and a conveyance belt driver that rotates any one of the conveyance belt rollers.

14. The medium conveyance device according to claim 1, wherein the one or more sensors comprises plural sensors spaced away from one another in the conveyance direction in the medium stacker.

15. A medium conveyance device comprising:

a first conveyance unit that applies a first conveyance force in a conveyance direction to a lowest medium in media stacked in a medium stacker, wherein the first conveyance unit comprises: a first auxiliary roller that applies the first conveyance force to a bottom surface of the lowest medium; a first driver that rotates or stops rotation of the first auxiliary roller; a second auxiliary roller that applies the first conveyance force to the bottom surface of the lowest medium; and a second driver that rotates or stops rotation of the second auxiliary roller;

a second conveyance unit disposed downstream in the conveyance direction of the first conveyance unit and that applies a second conveyance force in the conveyance direction to the lowest medium being conveyed in the conveyance direction;

a detector that includes one or more sensors configured to detect a height of the stacked media in the medium stacker in a height direction; and a controller that controls the first conveyance unit and the second conveyance unit, wherein based on the detected height of the stacked media in the medium stacker, the controller changes the first conveyance force applied to the lowest medium.

16. The medium conveyance device according to claim 15, wherein the one or more sensors of the detector comprises a first height sensor configured to detect whether or not any of the media stacked on the medium stacker is present at a first height reference position, wherein when the controller determines from a result of detection by the first height sensor that the media are not detected at the first height reference position, the controller refrains from rotating the first auxiliary roller.

17. The medium conveyance device according to claim 16, wherein the one or more sensors of the detector comprises a second height sensor that detects whether or not any of the media stacked on the medium stacker is present at a second height reference position lower than the first height reference position, wherein when the controller determines from a result of detection by the second height sensor that the media are not detected at the second height reference position, the controller refrains from rotating the second auxiliary roller.

18. The medium conveyance device according to claim 15, wherein the second conveyance unit comprises:

a conveyance belt that applies the second conveyance force to the medium being conveyed in the conveyance direction;

conveyance belt rollers on which the conveyance belt is wound; and a conveyance belt driver that rotates any one of the conveyance belt rollers.

19. The medium conveyance device according to claim 15, wherein the one or more sensors comprises plural sensors spaced away from one another in the height direction orthogonal to the conveyance direction.

20. The medium conveyance device according to claim 14, wherein the plural sensors comprise a first sensor disposed upstream in the conveyance direction of the first conveyance unit and a second sensor disposed downstream in the conveyance direction of the first conveyance unit.

* * * * *